United States Patent [19]

Crandal

[11] 4,340,311

[45] Jul. 20, 1982

[54] INTERFACIAL SURFACE GENERATOR MIXER

[75] Inventor: Edwin L. Crandal, Houston, Tex.

[73] Assignee: Zebron Corporation, Tualatin, Oreg.

[21] Appl. No.: 191,255

[22] Filed: Sep. 26, 1980

[51] Int. Cl.[3] ..... B01F 5/06

[52] U.S. Cl. ..... 366/336; 138/42

[58] Field of Search ..... 366/336, 337, 338, 339, 366/340, 341; 138/38, 42, 40, 37

[56] References Cited

U.S. PATENT DOCUMENTS

| | | | |
|---|---|---|---|
| 3,239,197 | 3/1966 | Tollar | 366/337 |
| 3,404,869 | 10/1968 | Harder | 366/338 |
| 3,406,947 | 10/1968 | Harder | 366/337 |
| 3,583,678 | 6/1971 | Harder | 366/340 |

*Primary Examiner*—Edward J. McCarthy
*Attorney, Agent, or Firm*—Vaden, Eickenroht, Thompson, Bednar & Jamison

[57] ABSTRACT

An interfacial surface generator for mixing fluids is disclosed that has a plurality of mixing elements positioned in a tubular housing in end-to-end relationship. Each element has a cavity on its upstream end and a protuberance on the downstream end. The protuberance on each element extends into the cavity of the adjacent element to form a narrow annular passageway between the side of the protuberance and the wall of the cavity and a narrow space between the end of the protuberance and the bottom of the cavity. Each element also has a central blind-end passageway that connects the space between the end of the protuberance and the bottom of the cavity with a plurality of radially extending passageways that connect the central passageway to the annular space between the protuberance and the wall of the cavity. The fluids being mixed flow together through the central passageway. The stream is divided into a plurality of substreams in the radially extending passageways and is discharged into the annular passageway between the protuberance and the wall of the cavity where it flows circumferentially around the protuberance and longitudinally in a thin annular stream to the passageway between the end of the protuberance and the bottom of the cavity. In this passageway the fluids move radially inwardly to enter the central opening of the next element and the mixing process is repeated.

2 Claims, 3 Drawing Figures

FIG. 1
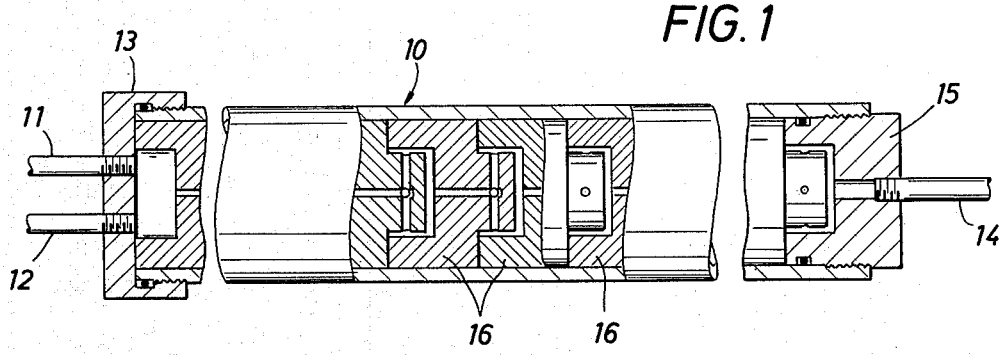
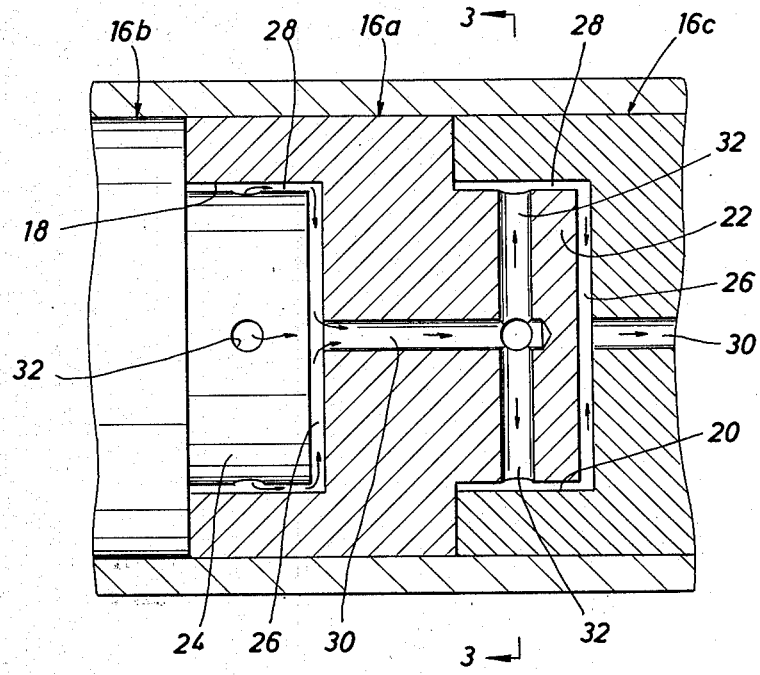
FIG. 2
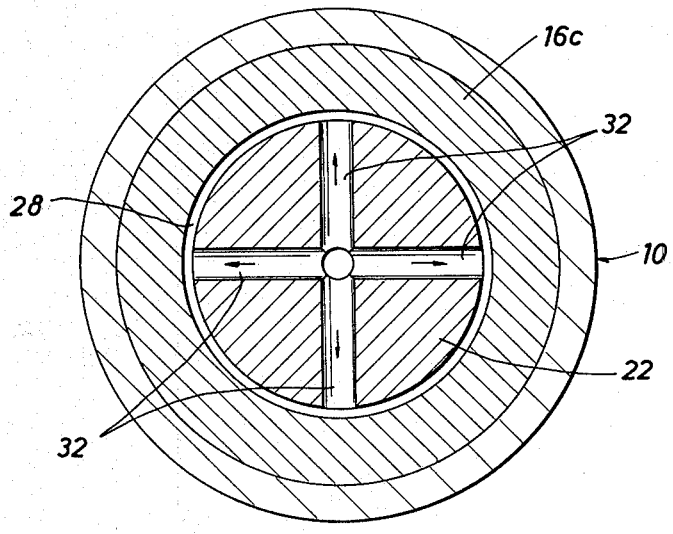
FIG. 3

INTERFACIAL SURFACE GENERATOR MIXER

This invention relates to a fluid mixer of the interfacial surface generator type.

Such mixers are known and described in U.S. Pat. Nos. 3,583,678, and 3,404,869 and the patents referred to therein. Such mixers are static devices, which are located in the pipeline carrying the fluids to be mixed. As the fluids are forced through the mixer, the fluid stream is divided, recombined, divided, and recombined a sufficient number of times to produce the desired mixing of the fluids.

It is an object of this invention to provide an interfacial surface generator mixer that employs a plurality of mixing elements positioned in end-to-end relationship in a housing with each element having passageways that combine and divide the fluid stream and which cooperates with adjacent elements to spread the fluid stream into a very wide, shallow stream that flows first longitudinally through a narrow annular passageway then radially through a narrow passageway to a central passageway where the fluids are recombined, which results in a thorough mixing of the fluids.

It is another object of this invention to provide an interfacial surface generator fluid generator having a plurality of mixing elements that cooperate in a novel manner to provide passageways that spread the fluids into a wide, narrow stream that then conveys into a central stream thereby producing an efficient mixing of the fluids.

It is another object of this invention to provide mixing elements for such a mixer that is easily machined from metal or plastic using conventional machining operations.

These and other objects advantages and features of this invention will be apparent to those skilled in the art from a consideration of this specification, including the attached drawings and appended claims.

IN THE DRAWINGS

FIG. 1 is a view partly in section and partly in elevation of the preferred embodiment of the interfacial surface generator mixer of this invention;

FIG. 2 is a sectional view, also partly in elevation and partly in section, on an enlarged scale of a portion of the assembled mixing elements employed in the mixer of FIG. 1; and FIG. 3 is a sectional view taken along line 3—3 of FIG. 2.

Interfacial surface generator type mixers are positioned directly in the flow line carrying the material to be mixed. In FIG. 1 elongated tubular housing 10 is connected at one end to inlet lines 11 and 12 through end cap 13. At the other end, outlet 14 is connected to plug 15, which is screwed in the end of housing 10. Between the inlet end and the outlet end of the housing are a plurality of mixing elements 16 in end-to-end relationship. Each element has internal passageways through which the fluids must flow. Adjacent elements also combine to form additional passageways through which the fluids are forced as they flow through the mixer housing. The passageways are designed to thoroughly mix the fluids by the time they pass out of the mixer through line 14.

In the drawings, only two inlet lines are shown; however, the mixer can mix more than two fluids.

All of the mixing elements are identical. Preferably, housing 10 is tubular and the mixing elements are all circular in cross section. This allows the elements to be easily machined on a standard screw machine.

Referring to FIG. 2, which shows in cross section one complete mixing element indicated by the number 16*a* and portions of the two mixing elements 16*b* and 16*c* that are located upstream and downstream of element 16*a*, respectively. Each element has a flat-bottomed, circular, cavity on its upstream end, such as cavity 18 in element 16*a* and cavity 20 in element 16*c*. Each element has a protuberance on its downstream side, such as protuberance 22 on element 16*a* and 24 on element 16*b*. Protuberance 24 on element 16*b* extends into cavity 18 on element 16*a* and protuberance 22 extends into cavity 20 on element 16*c*. The length of the protuberances is not as great as the depth of the cavities to provide passageways between the ends of the protuberances and the bottoms of the cavities. These passageways are indicated by the number 26. Also, the outside diameter, or the width, of the protuberances is less than the width or diameter of the cavities to provide passageways between the outside surfaces of the protuberances and the inside walls of the cavities. Such passageways are indicated by the numbers 28.

Each element has a central, blind-end passageway extended along its longitudinal axis. These passageways are indicated by the number 30. Adjacent the blind end of central passageway 30 are a plurality of radially extending openings or passageways 32 that connect the central passageway 30 to annular passageway 28 between the outside of the protuberance and the wall of the cavity. In the embodiment shown, four such radial passageways are shown. More or less could be used, although the stream should be divided into at least two streams. Also, preferably, no effort should be made to align the radial passageways so that they lie in the same plane with the other radial passageways in adjacent elements since it is the purpose of these passageways to divide the fluid stream into substreams and better mixing is obtained if the discharge point for these passageways varies from element to element with respect to a given reference plane.

In the drawings, the diameter of the central passageway 30 and radial passageways 32 are the same. Obviously, this will cause the fluids to flow much faster in the central passageway than they do in the radial passageways. The diameter of the radial passageways could be adjusted, of course, to reduce or eliminate this difference in the rate of flow. It is believed, however, that a relatively high flow rate should be maintained in the central passageway because it will tend to create some turbulence at the end of the passageway when the fluids are forced to abruptly change their direction of travel.

In operation, the fluid stream made up of the fluids to be mixed flows through central passageway 30 of element 16*b* and is divided into four substreams, in radial passageways 32. The fluids are discharged from the radial passageways into annular passageway 28 between protuberance 24 and cavity 18. In passageway 32, the fluids flow circumferentially around the protuberance and moves toward passageway 26 in a thin annular stream. In passageway 26, again as a thin stream, the fluids converge toward the inlet of central passageway 30 in element 16*a*. The mixing process is then repeated as the fluid flows through the next element 16*c*.

In summary, the fluids are combined into one stream in central passageway 30. They are next divided into a plurality of substreams. The fluids then flow circumferentially around a protuberance and move in a thin annular stream to passageway 26, where still as a relatively thin stream, they are forced to converge at the opening of central passageway 30. This results in a very efficient mixing of the fluids as they travel from element to element through the mixer.

In the above description, the flow of the fluid has been described as being from left to right from the central passageway to the radial passageways, etc. It should be understood that the flow could be reversed. The mixing elements could be turned around in the housing so that the fluids flow from the central passageway 30 of the elements upwardly in a fan-shaped, thin stream through passageway 26, then over the protuberances through passageway 28 into the outer end of radial passageways 32 and back into the next central passageway. This would produce the same efficient mixing action.

This mixer has been found to be very efficient at mixing materials of substantially different viscosities. For example, its mixing ability was tested using a polyurethane resin having a viscosity that varied between 3500 to 5000 cps with an activator having a viscosity of 189 cps. The mixing ratio was 3 to 1 in one instance and 2 to 1 in another and in both cases the materials were thoroughly mixed using a mixer having nine mixing elements of the type described above.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. An interfacial surface generator mixer comprising a housing having an inlet and an outlet and a plurality of mixing elements in end-to-end relationship in the housing, each member having a cavity in one end and a protuberance on the opposite end that extends into the cavity in the adjacent member to form a passageway between the outside surface of the protuberance and the cavity and a passageway between the end of the protuberance and the bottom of the cavity, a central blind end passageway along the longitudinal axis of each member having one end connected to the space between the end of the protuberance and the cavity and a plurality of equally spaced, radially extending passageways connecting the central passageway adjacent its blind end to the passageway between the outside surface of the protuberance and the cavity.

2. An interfacial surface generator mixer for mixing two or more fluids comprising a housing and a plurality of mixing elements in end-to-end relationship in the housing, each element having a cavity on the upstream end and a protuberance on the downstream end with the protuberance of each element extending into the cavity of the adjacent element, said protuberance having a length less than the depth of the cavity to form a relatively narrow space between the end of the protuberance and the bottom of the cavity, said protuberance further having a width less than the width of the cavity to form a longitudinally extending space between the protuberance and the inside wall of the cavity, each element having a blind end central passageway extending along its longitudinal axis through which all of the fluid passes, a plurality of passageways connecting the central passageway to the space between the protuberance and the inside wall of the cavity to divide the stream of fluid in the central passageway into a plurality of separate streams that discharge into the space between the protuberance and the cavity where the fluid forms a thin stream flowing circumferentially around the protuberance and into the space between the end of the protuberance and the cavity to flow radially inwardly to be again combined into one common stream in the central passageway of the next mixing element.

* * * * *